United States Patent [19]

Kunioka et al.

[11] 4,033,737

[45] July 5, 1977

[54] METHOD OF COOLING A STEEL MATERIAL WITHOUT DEFORMATION

[75] Inventors: Kazuo Kunioka, Yokohama; Kiwami Kurihara, Musashino; Koji Sakasegawa, Hiroshima; Atushi Ohsumi, Hiroshima; Akio Watanabe, Hiroshima; Kenichi Sakai, Okayama, all of Japan

[73] Assignee: Nippon Kokan Kabushiki Kaisha, Tokyo, Japan

[22] Filed: Apr. 1, 1975

[21] Appl. No.: 564,191

Related U.S. Application Data

[63] Continuation of Ser. No. 341,063, March 14, 1973, abandoned.

[52] U.S. Cl. ..... 62/64; 266/134

[51] Int. Cl.² ..... F25D 17/02

[58] Field of Search ..... 62/62, 64; 134/64 R, 134/122 R; 164/283 S, 340; 266/45, 65, 134

[56] References Cited

UNITED STATES PATENTS

| | | | |
|---|---|---|---|
| 3,303,062 | 2/1967 | Clumpner et al. | 266/65 X |
| 3,339,373 | 9/1967 | Möbius et al. | 62/64 |
| 3,358,744 | 12/1967 | Rossi | 164/283 S X |
| 3,468,362 | 9/1969 | Burkhardt et al. | 134/122 X |
| 3,659,428 | 5/1972 | Kunioka et al. | 62/64 |

FOREIGN PATENTS OR APPLICATIONS

| | | | |
|---|---|---|---|
| 454,102 | 9/1936 | United Kingdom | 62/64 |

*Primary Examiner*—Ronald C. Capossela
*Attorney, Agent, or Firm*—William Anthony Drucker

[57] ABSTRACT

When a concavity-shape part is formed in the center of skid material and cooling mechanism is arranging in the concavity-shaped hole, a steel material, e.g. slab, bloom or the like, can be cooled without any of deformation of said material.

6 Claims, 10 Drawing Figures

METHOD OF COOLING A STEEL MATERIAL WITHOUT DEFORMATION

This is a continuation of application Ser. No. 341,063 filed Mar. 14, 1973 now abandoned.

The invention relates to a method for cooling a steel body, for example a bloom, slab, billet or the like, and more particularly to a method for cooling the steel without deformation and warping.

There have been proposed various ways of cooling heated steel materials, such as the skid system, roll gang system, water-cooling vessel system or cooling yard system. Among them, the roll gang affords a good way of cooling steel without any risk of deformation but this system is not suited for a cooling operation taking several tens of minutes. The water-cooling vessel system is capable of shortening the cooling period of time, but in order to ensure non-deformation it is necessary to rotate the steel in the cooling water vessel, or in the case of a slab it must be vertically held in said vessel, so a large scale installation and complicated operation are required and further the steel material itself is limited as to the size which can be cooled down. The cooling yard system necessitates sufficient area therefor, and this system requires a fairly large number of steps for on-line operation.

In these circumstances, the skid system is widely employed.

In the skid system, steel is placed on a skid to cool. In order to prevent distortion of the steel material, the prior art methods minimize the difference in temperature between the skid-contacting area of the steel body and the remaining area by (i) slowing the cooling speed, (ii) making the width of the skid narrow to decrease the area contacting the billet, or (iii) carrying out intermittent colling to make the temperature of the steel uniform by leaving in the atmosphere. However, in the first case, it takes a relatively long cooling time so that it is necessary to widen the area of the cooling bed. In the second case, the skid is not so strong to support the heavy weight of steel material to be cooled thereon, and when the distance between the skids is narrowed, although such skids may then support the heavy steel material, the strength of the skids to distortion is considerably reduced. The third case requires a lesser number of cooling means than in the first case, but increases the area of the cooling bed and takes a relatively long cooling time.

With a view to avoiding such inconvenient circumstances, the present invention has succeeded in providing an effective cooling system by means of a simple facility without bringing about any deformation on the steel material. The essence of this invention lies in providing a cavity in the center of the skid, and arranging a cooling mechanism in the cavity of the skid to provide a cooling effect within the hollow space thereof.

The object of this invention is accordingly to provide an improved method of cooling steel, e.g. slab, billet or the like, without any of deformation of the steel.

Other objects and advantages of the invention will be apparent from the following description with reference to the accompanying drawings, in which:

FIGS. 2 to 4 are similar views showing embodiments of skid utilised in the invention, wherein FIG. 2 is an embodiment having a spraying nozzle inserted in the cavity; FIG. 3 shows an embodiment having a two-phase jetting flow nozzle mixing liquid and air, and FIG. 4 shows an embodiment having also a two-phase jetting flow nozzle with mand small perforations or slits;

FIGS. 5 to 8 are diagrams showing the changes in temperature of the steel when the cooling effects of the method of the invention, and of the prior art methods are given to the skid-contacting area, wherein FIG. 5 illustrates the prior art;

FIG. 6 illustrates an effect obtained with the invention;

FIG. 7 illustrates pre-cooling effected on the skid-contacting area, and FIG. 8 also illustrates the pre-cooling on the skid-contacting area;

In these drawings, the reference number 1 is a steel body, 2 a skid, 3, 4 are spray nozzles, 5, 8, gas supplying pipes 6, 7 are liquid-supplying pipes. In the diagrams, 1 refers to the upper surface of the steel being cooled, 1′ refers to the bottom of the same, 2 refers to the central part thereof, 3 and 3′ refer to the skid-contacting area in the invention, and 4 refers to air cooling curves.

Figure 1:
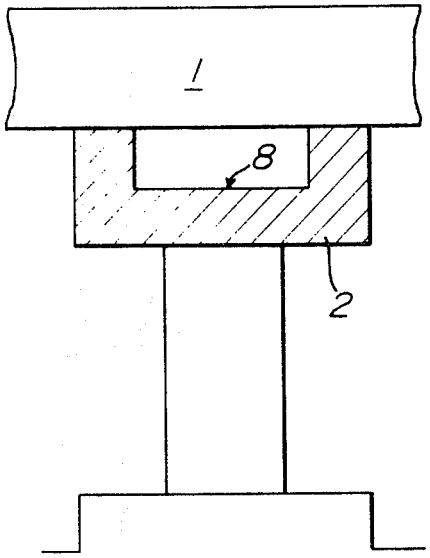
FIG. 1 is a partial cross-section of a conventional skid.
Figure 3:
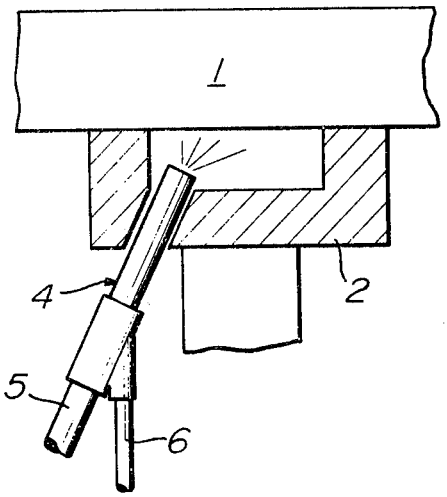
Figure 2:
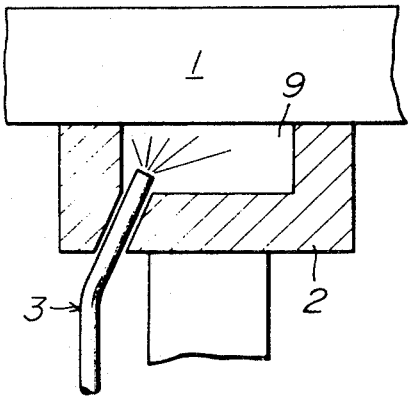
Figure 4:
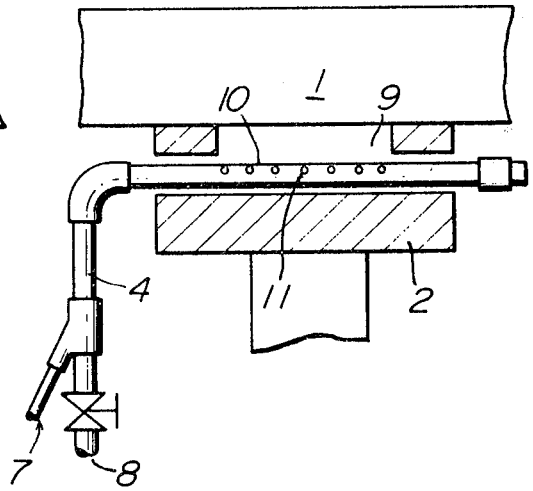

The invention provides a cooling effect in an inner hole or cavity 9 of the skid 2 which is equipped with a cooling means and supports the slab 1. The cooling means may be variously embodied as a spraying nozzle as shown in FIG. 2, or as a two-phase jetting flow nozzle mixing liquid and gas by arranging in parallel the gas-supplying pipe 5 and the liquid-supplying pipe 6 as shown in FIG. 3, or as the nozzle having within the cavity 9 many small perforations or slits on the jetting portion 10 providing a water-jetting pipe 7 on the liquid-supplying pipe 8 as shown in FIG. 4. Thus, the average value of the slab surface temperature makes almost equal the temperature of the skid-contacting area and that of non-contacting area.

Figure 5:
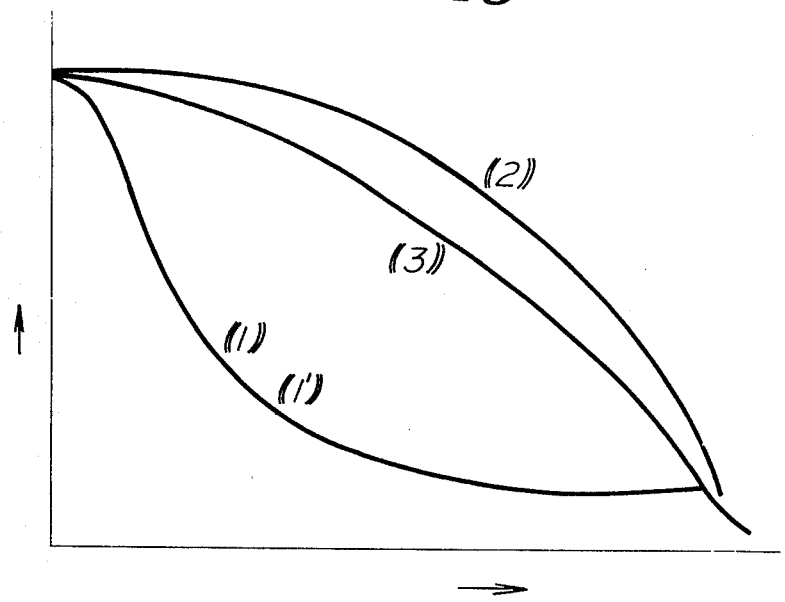
Figure 6:
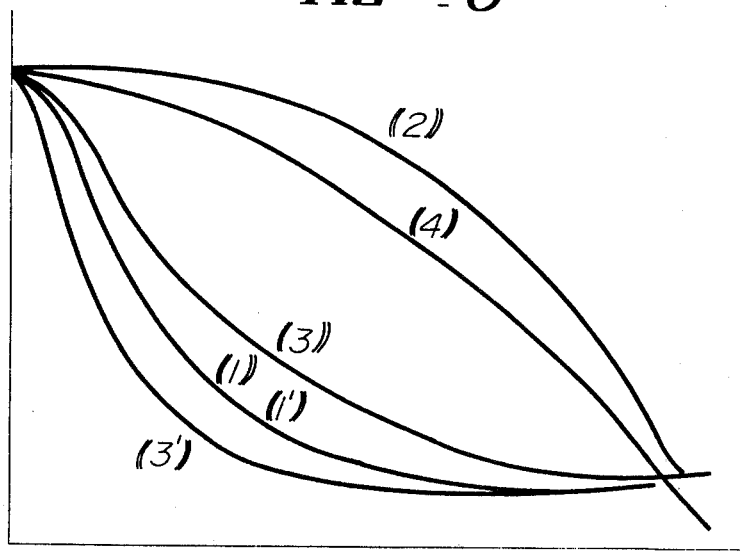
Figure 7:
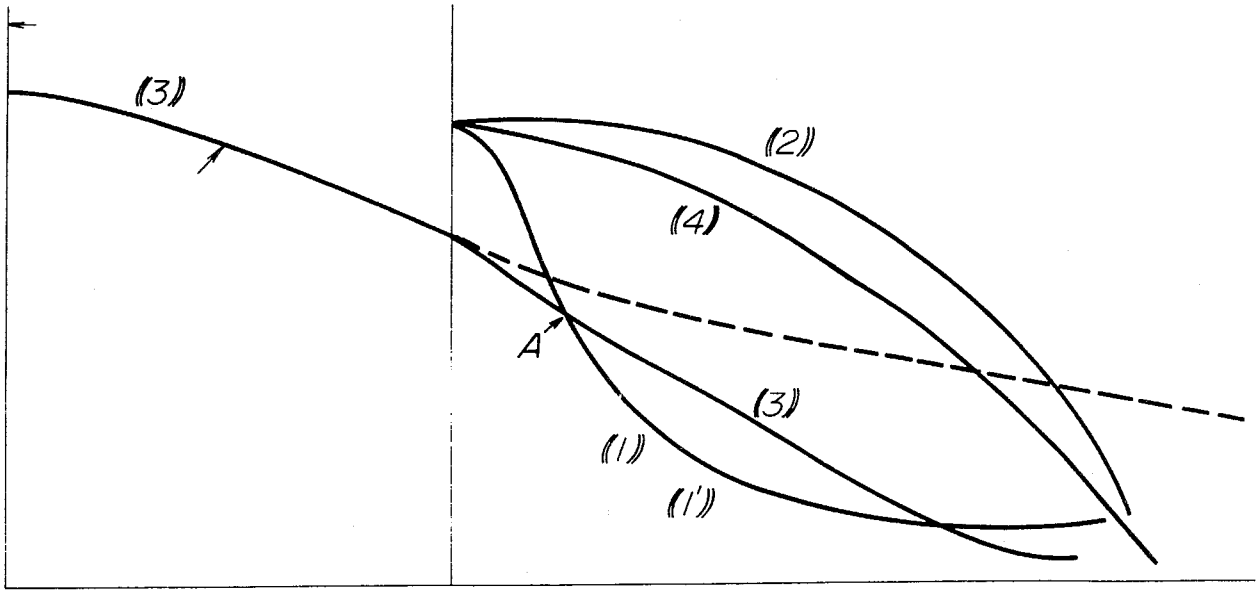
Figure 8:
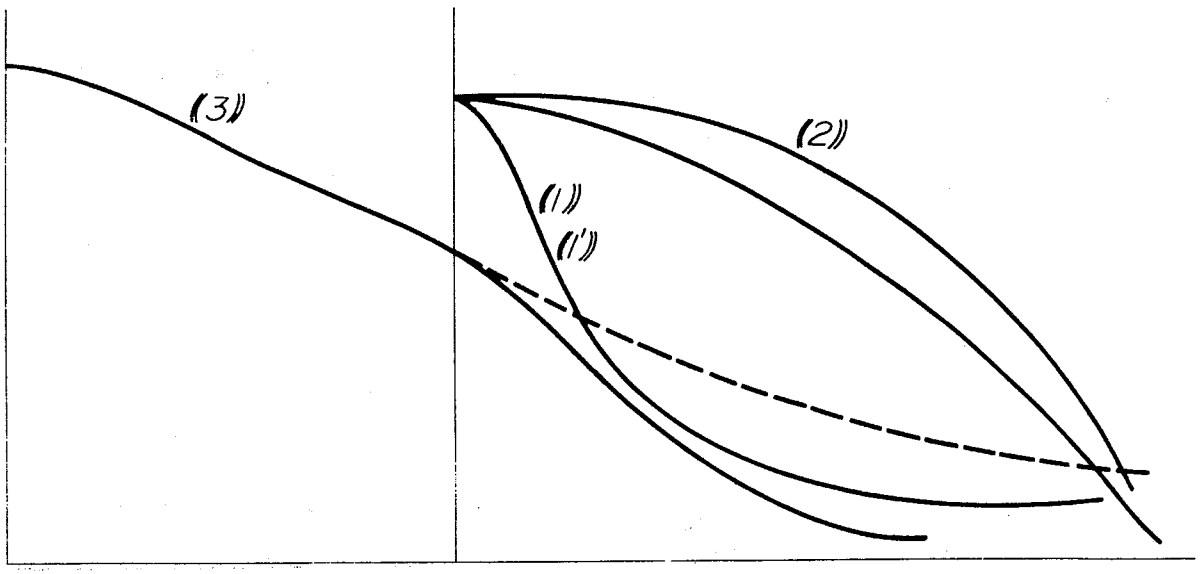

The cooling capacity and rate may be set up depending on dimensions and temperature of the steel material with partial automatic control or full automatic control. It is advantageous to employ a device as shown in FIG. 4 for uniform cooling. The two-phase jeting flow device shown in FIG. 3 is preferable for possible variation between a high cooling rate with a small amount of water, to the air cooling rate. It is necessary for cooling the skid-contacting area and other area at the same cooling rate to adjust the ratio of the liquid amount to the gas amount and/or the gas pressure, and the relationships therebetween are shown in FIGS. 5 to 8. FIG. 5 shows the relation according to the prior art which does not give the cooling effect to the skid-contacting area, in which the curve 1 and 1′ is a change of temperature on the upper and lower surface of the slab relative to time, the curve 2 is a change of temperature on the central part of the slab and the curve 3 is that of the skid-contacting area. In this connection, the curve 1, 1′ rapidly lowers, while the curves 2 and 3 show the very moderate cooling effects, and the slab is warped at the skid-contacting points which are the lower surface of the slab. On the other hand, FIG. 6 shows that the skid-contacting areas are also cooled according to the invention. 4 being the case of air-cooling the skid. Also in this case, the skid-contacting areas are weak in stress where the cooling at the skid-contacting area does not reach the cooling effect shown with the curve 1, 1' as the curve 3 does, and the warping is noted, though improved more than the case of FIG. 5. Therefore, a cooling curve of the curve 3' is preferable which is a little above the curve 1, 1'. FIG. 7 is the case of cooling the skid-contacting area prior to other parts. Thus, when cooling the skid contacting points of the steel material at high temperature, stresses occur at such portions of the steel but as most parts of the whole steel material are at a higher temperature than the skid-contacting area, the stress thereon acts in the releasing direction, and since the stresses generated remain within the small portions, such stresses are not so great as to warp the whole body so that the preferable cooling is obtained. It has been confirmed that when the crossing points A between the cooling curve 3 of the skid-contacting area and the coolng curve 1, 1' of the other area is below 450° C. said warping is completely avoided. In this case, if the skid-contacting area is further cooled so that as shown in FIG. 8 the cooling curve 3 does not cross the cooling curve 1, 1', the stable cooling may be effected without warping.

The following are Examples of the embodiments according to the proposed method

EXAMPLE 1

Figure 9:
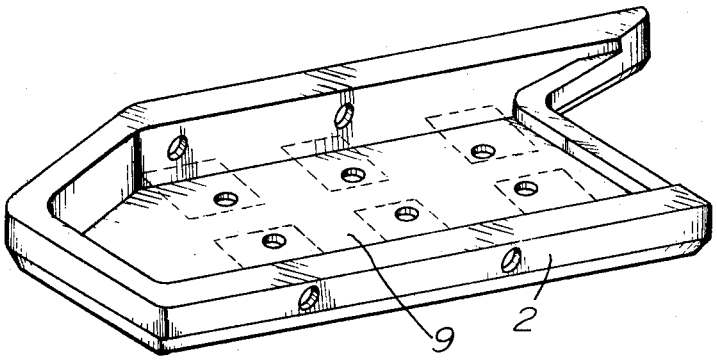
FIG. 9 is a perspective view showing an examplary skid employed in carrying out the method of the invention.
Figure 10:
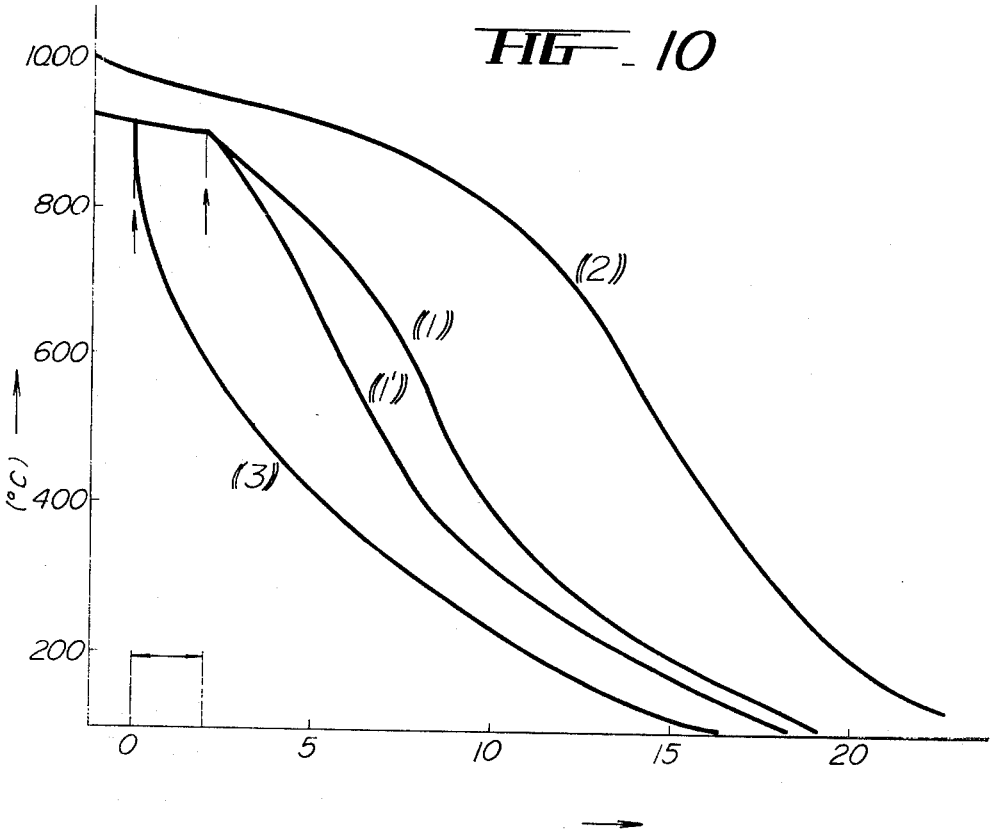
FIG. 10 is a diagram of the cooling curves of a bloom cooled in accordance with the invention.

A steel bloom of 180mm thickness, 220mm width and 3800mm length and heated to 925° C at upper surface and 1000° C at central part was placed on the skid as shown in FIG. 9 wherein the depth of inner hole or cavity is about 60mm, and cooling water of 40 litre/min.m$^2$ was applied to the top surface and at 80 litre/min.m$^2$ to the bottom surface, in this connection when the cooling water of 140 litre/min.m$^2$ was jetted before 2 minutes into said cavity 9 by means of the spraying means as shown in FIG. 4, the cooling curve at each part of the bloom was shown in FIG. 10, and the whole surface was below 100° C within 20 minutes.

The amount of warping experienced was measured as to the thus cooled bloom with distance of 500mm, (at the both end, 400mm) with the results of 0 to 4mm warp at each part (one end and the center: 0mm). Thus, a markedly improving effect was confirmed in comparison with the prior art where in the case of said bloom, the warping amount was 500 to 600mm.

EXAMPLE 2

A steel bloom of 181mm thickness, 218mm width and 3850mm length was extracted at the temperature of 1260° C and cooled as in Example 1 after scale-breaking. Warping was little noted on the top surface, and the fact of the effective cooling method was confirmed.

EXAMPLE 3

A steel bloom of 181mm thickness, 219mm width and 3830mm length was extracted at the temperature of 1260° C and cooled in the same manner as in Example 1, with 40 litre/min.m$^2$ water to the top surface and the 68 litre/min.m$^2$ water to the bottom surface. The warping amount was 0 to −4mm, and as mentioned above, it was confirmed that the method of the invention was an effective cooling method. According to this Example, although the amount of cooling water fed to the bottom surface was smaller than that of the prior art, the preferable cooling result was provided.

According to the method of the invention, it is possible to cool the slab in a short period of time without it becoming deformed, thereby to make the subsequent treatment easy and to considerably increase production as a result of the short cooling time. Further the quantity of water used may be decreased, there is no need for turning machines, and the desired purpose is smoothly accomplished in a small cooling yard. Thus, the invention has many effects with industrially practical high value.

We claim:

1. A method of cooling a steel body which comprises the steps of:

i. providing a skid having a base and peripheral upstanding walls defining a central cavity, ii. placing said steel body on the upper edges of the peripheral upstanding wall and positioned above the central cavity, iii. directing a liquid coolant, admixed with gas to form a two-phase jet flow, into the central cavity to cool the undersurface of the steel body overlying the central cavity and, iv. directing the liquid coolant onto a remaining area of the steel body, whereby the difference in temperature between the skid-contacting area of the steel body and the remaining area is minimized thereby to cool the steel without deformation.

2. A method, according to claim 1, wherein the skid-contacting area of the steel body is pre-cooled prior to cooling the remaining area.

3. A method, according to claim 2, wherein the ratio of the amount of liquid to the amount of gas is controlled to control the cooling rate.

4. A method, according to claim 2, wherein the ratio of the amount of liquid to the gas pressure is controlled to control the cooling rate.

5. A method, according to claim 4 wherein the coolant is a mixture of liquid and gas and the ratio of the amount of liquid to the amount of gas is controlled to control the cooling rate.

6. A method, according to claim 1, wherein the ratio of the amount of liquid to the gas pressure is controlled to control the cooling rate.

* * * * *